US006468358B1

(12) United States Patent
Courson et al.

(10) Patent No.: US 6,468,358 B1
(45) Date of Patent: Oct. 22, 2002

(54) CONFINED UNDERWATER CRYOGENIC SURFACE PREPARATION

(75) Inventors: Billy Courson, Panama City Beach; John Shelburne, Lynn Haven, both of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/715,210

(22) Filed: Nov. 14, 2000

(51) Int. Cl.[7] ..... B08B 5/00

(52) U.S. Cl. ..... 134/4; 134/6; 134/7; 134/30; 134/31; 134/36; 134/37; 134/42; 451/36; 451/38; 451/39

(58) Field of Search ..... 134/4, 6, 7, 30, 134/31, 36, 37, 42; 451/36, 38, 39

(56) References Cited

U.S. PATENT DOCUMENTS 4,447,952 A * 5/1984 Elkins ..... 30/361
5,028,273 A * 7/1991 Weltmer, Jr. et al. ..... 134/42
5,125,979 A * 6/1992 Swain et al. ..... 134/7
5,222,332 A * 6/1993 Mains, Jr. et al. ..... 51/320
5,341,608 A * 8/1994 Mains, Jr. et al. ..... 51/320
5,599,223 A * 2/1997 Mains, Jr. ..... 451/39
6,259,653 B1 * 7/2001 Courson et al. ..... 367/141

* cited by examiner

*Primary Examiner*—Sharidan Carrillo
(74) *Attorney, Agent, or Firm*—Harvey A. Gilbert; Donald G. Peck

(57) ABSTRACT

A portable, diver-operated cryogenic freezing unit cleans surfaces underwater. A housing has a first chamber that contains cryogenic liquid, such as liquid nitrogen, and a second chamber is disposed adjacent to an end portion that fits about contaminating matter on a surface underwater. A valve vents cryogenic liquid from the first chamber to expand as gas in the second chamber. The vented cryogenic liquid and gas freeze a slug of water and the contaminating matter on the surface within the end portion. The housing is bent, twisted or otherwise displaced to break or pry-away and remove the frozen slug of water and contaminating matter from the surface to thereby clean it. A method of cleaning a surface underwater using the cryogenic freezing unit is described.

8 Claims, 1 Drawing Sheet

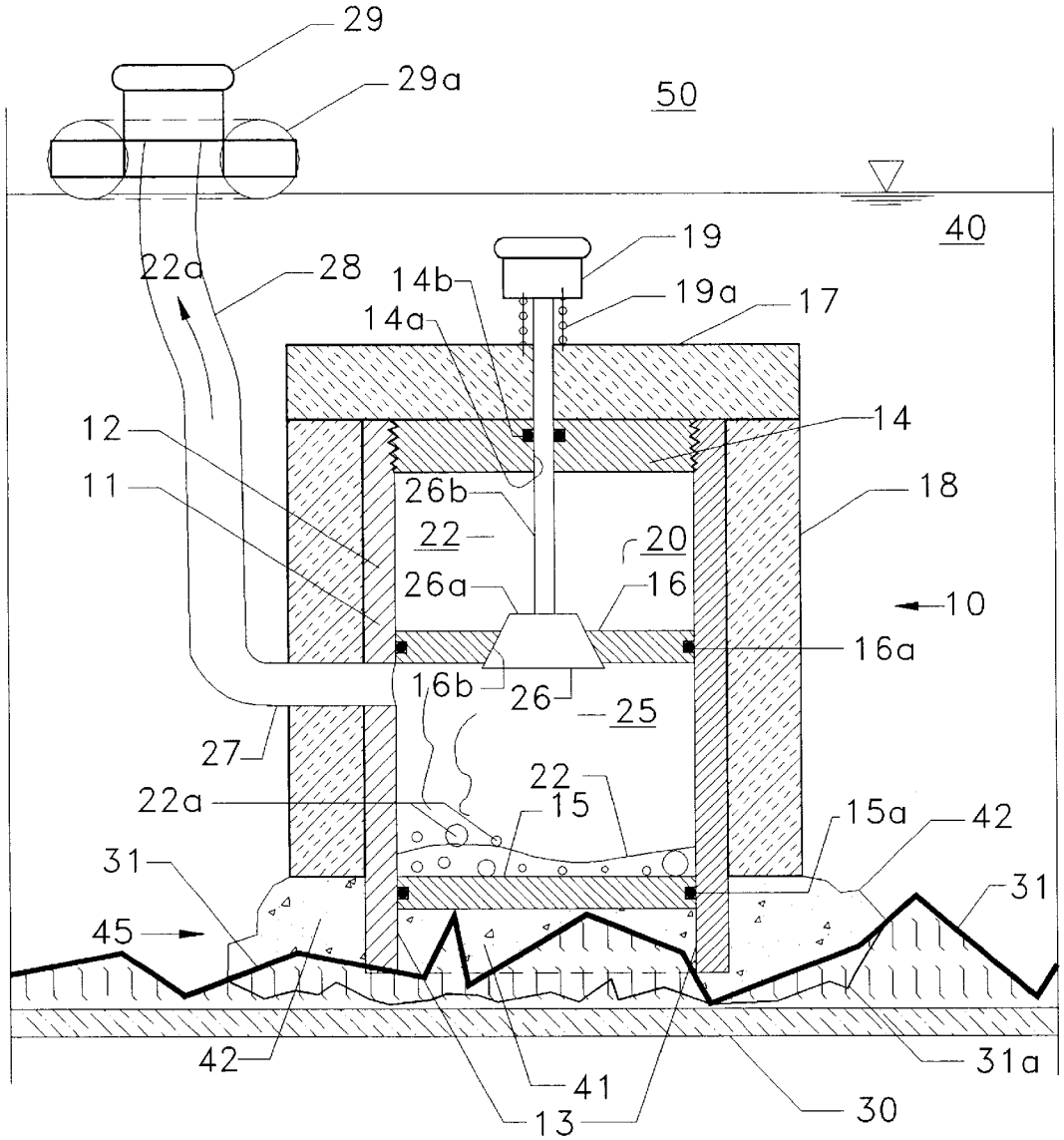
10
11
12
13
14
14a
14b
15
15a
16
16a
16b
17
18
19
19a
20
22
22a
25
26
26a
26b
27
28
29
29a
30
31
31a
40
41
42
45
50

CONFINED UNDERWATER CRYOGENIC SURFACE PREPARATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to devices to clean surfaces underwater. More particularly, the cleaning device of this invention is portable by a diver and uses cryogenic liquid to clean contamination from surfaces underwater.

An underwater surface can be cleaned (prepared) by a number of methods. Such approaches use systems of brushes, scrapers and water-jets, and are not truly portable, since the systems are too large and heavy to be carried by a single diver. These methods usually employ frictional mechanical action that discharges removed contaminants into the ambient water and creates levels of noise that may be harmful. These systems also consume large quantities of power, are very costly, and usually require operational support from equipment located on the surface.

Thus, in accordance with this inventive concept, a need has been recognized in the state of the art for a quick and effective cleaner of contamination from surfaces underwater that is portable and quiet and does not contaminate the environment.

SUMMARY OF THE INVENTION

The present invention provides a cryogenic freezing unit including a housing having a first chamber containing cryogenic liquid and a second chamber disposed adjacent to an end portion that fits about contaminating matter on a surface underwater. A valve vents cryogenic liquid from the first chamber to the second chamber, creates gas and freeze a slug of water and the contaminating matter on the surface within the end portion. The housing is displaced to break, or pry away the frozen slug of water from the surface and remove all contaminating matter. The invention also includes a method of cleaning a surface underwater using the cryogenic freezing unit.

An object of the invention is to provide a method of and device for using a cryogenic freezing unit to clean a submerged surface.

Another object is to provide a method of and portable device for cleaning a surface underwater by a single diver.

Another object is to provide a method of and portable device for cleaning a surface underwater that can be held against the surface which is to be cleaned to isolate cleaning by cryogenic freezing from the outside environment.

Another object is to provide a method of and device for cleaning an underwater surface that is essentially stealthy, unobtrusive and easy to handle.

Another object is to provide a method of and portable device for cleaning an underwater surface that is uncomplicated and only requires opening a valve to release cryogenic liquid, waiting for freezing to be completed and then pulling the receptacle away from the cleaned surface.

Another object is to provide a method of and portable device for cleaning a submerged surface relying on freezing a slug of water and contaminating matter, and breaking-away the frozen slug of water and contaminating matter from the surface to remove the contaminating matter including biological growth, scale and rust.

Another object is to provide a method of and portable device for cleaning a submerged surface having a housing containing a reservoir of cryogenic liquid and a chamber where vented cryogenic liquid vaporizes, or boils-off to freeze a frozen slug of water and contaminating matter for removal.

Another object of the invention is to provide a method of and device for cleaning a surface underwater using cryogenic liquid to freeze a slug of frozen water and contaminating matter and a housing displaced to break, or pry the frozen slug off of the submerged surface.

These and other objects of the invention will become more readily apparent from the ensuing specification when taken in conjunction with the appended claims.

BRIEF DESCRIPTION OF THE DRAWINGS

The FIGURE is a schematic representation of the device of the invention shown partially in cross section for cleaning contaminating matter from a surface underwater.

DESCRIPTION OF THE PREFERRED EMBODIMENT

Referring to the FIGURE, cryogenic freezing unit 10 is portable by a diver-operator and can be used at various depths in water 40 to clean a submerged surface 30 of contaminating matter 31. Surface 30 can be metal (or other materials) of undersea structural components, instrumentation packages, sensors, ordnance, etc. Contaminating matter 31 can include fouling caused by marine growth including barnacle shells, mollusk shells, plus a host of other marine growth and organisms, and/or a number of chemical compounds such as rust, scale, sand, grease, dirt, grime, etc.

Cryogenic freezing unit 10 has a waterproof housing 11 having a cylindrically-shaped portion 12, rim-shaped end portion 13 at one end, and a threaded cap member 14 at the other end. An inner wall portion 15 of cylindrically-shaped portion 12 of housing 11 is disposed adjacent to rim-shaped end portion 13 and is secured to close cylindrically-shaped portion 12 and may use a resilient annular O-ring seal **15*a* for this purpose and to give the capability of axially displacing inner wall 15 in cylindrically-shaped portion 12 when it is better to have rim-shaped end portion 13 have greater depth. Such greater depth may be desirable when contaminating matter 31 has such enlarged irregularities that a shallower rim-shaped end portion may not otherwise be able to fit about the enlarged contaminating matter 31**.

A middle wall portion 16 separates the interior of cylindrically-shaped portion 12 of housing 11 into first and second chambers 20 and 25. Middle wall portion 16 may be force fitted in place and have an O-ring seal **16*a*, or middle wall 16 may be molded part of housing 11. Valve 26 has a cone-shaped stopper 26*a* seated in an appropriately recessed cone-shaped valve seat 16*b* that mates with stopper 26*a* to seal chamber 20 from chamber 25. Valve 26 is connected to an actuation shaft 26*b* that extends through chamber 20 and through a bore 14*a* sealed by O-ring 14*b* in threaded cap member 14**.

Chamber 20 is filled with cryogenic liquid 22. A typical cryogenic liquid 22 is liquid nitrogen, although other cryogenic liquids could be used depending on a number of factors including availability, safety, etc. Threaded cap member 14 can be unthreaded from housing 11 to fill chamber 20 with cryogenic liquid 22, and after filling, cap member 14 may be threaded back into housing 11 to contain and seal it.

Housing 11 including its constituents cylindrically-shaped portion 12, rim-shaped end portion 13, threaded cap member 14, inner wall portion 15, and middle wall portion 16 can be made from metal or some other material that readily conducts heat. In particular, rimshaped end portion 13 and inner wall portion 15 are made from a heat conductive material to assure freezing of water and contaminating matter 31 as explained below.

A disc-shaped top 17 and cylindrically-shaped shell 18 of insulating material cover cylindrically-shaped portion 12 and threaded cap member 14 of housing 11. This insulating material helps keep cryogenic liquid 22 in chamber 20 in the liquid state while cryogenic freezing unit 10 is being transported by a diver to a submerged work site. Rim-shaped end portion 13 and inner wall portion 15 are not covered with insulating material so that their heat conductive material can assure freezing of water and contaminating matter 31.

Push button 19 has biasing spring 19*a* between it and insulating top 17 to keep cryogenic liquid 22 in chamber 20 and out of chamber 25. Push button 19 is biased away from housing 11 by biasing spring 19*a* which also creates a biasing force that pulls on, or biases shaft 26*b* to seat stopper 26*a* of valve 26 on valve-seat 16*b* of valve 26 to seal chamber 25 from chamber 20.

A fitting 27 extending through insulating shell 18 and cylindrically-shaped portion 12 of housing 11 is coupled to a hose 28 reaching to an outlet 29 on a float 29*a* on the surface of water 40. When gas 22*a* is created from cryogenic liquid 22 in chamber 25, it is ducted through fitting 27, hose 28, and outlet 29 where gas 22*a*, or gaseous state 22*a* of cryogenic liquid 22 escapes to ambient air 50.

A diver carries cryogenic freezing unit 10 having cryogenic liquid 22 in first chamber 20 to an underwater work site where contaminating matter 31 covers, or at least partially covers submerged surface 30 that needs to be cleaned. The diver places cryogenic freezing unit 10 so that rim-shaped end portion 13 fits about contaminating matter 31 on submerged surface 30. This substantially isolates portion 41 of water 40 and contaminating matter 31 inside rim-shaped end portion 13 and adjacent to inner wall portion 15. Push button 19 is depressed by the diver to overcome the biasing force of biasing spring 19*a*, and stopper 26*a* of valve 26 is displaced inwardly from valve seat 16*b* of valve 26. Cryogenic liquid 22 is vented, or released from first chamber 20, through valve 26, and into second chamber 25. The reduced pressure and relative warmth of structure defining chamber 25 causes cryogenic liquid 22 to boil away and creates gas 22*a*, or the gaseous form 22*a* of cryogenic liquid 22 in second chamber 25.

Cryogenic liquid 22 in second chamber 25 and gas 22*a* that is created from cryogenic liquid 22 in second chamber 25 freeze portions 41 of ambient water 40 and contaminating matter 31 that are inside of rim-shaped portion 13 and on surface 30, and cryogenic liquid 22 in second chamber 25 and gas 22*a* from cryogenic liquid 22 in second chamber 25 also freeze another essentially ring-shaped portion 42 of ambient water 40 and contaminating matter 31 that are within a small distance of about a few centimeters outside and around rim-shaped portion 13 and on surface 30. The frozen portions 41 and 42 and contaminating matter 31 are frozen together in a roughly disc-shaped slug 45 of frozen portions of water 41 and 42 and contaminating matter 31 and also within and under portions 41 and 42.

The diver exerts pushing and/or pulling force on housing 11 sidewards along the region of disc-shaped top 17 and threaded cap member 14 or exerts a twisting force on housing 11 to break, or pry away slug 45 of portions 41 and 42 of water and contaminating matter 31 from surface 30. Breaking away slug 45 of portions 41 and 42 of water and contaminating matter 31 leaves surface 30 clean.

During freezing of slug 45 while heat is being drawn out of the constituents of slug 45, gas 22*a* is exhausted from second chamber 25 to air 50 at the surface via fitting 27, hose 28 and outlet 29. Since housing 11 is rigid and essentially closed, and flexible hose 28 is rigid enough to not collapse under expected ambient water pressures at anticipated depths, the same pressure (atmospheric pressure) is present in second chamber 25 as at outlet 29. Therefore, when gas 22*a* in second chamber 25 is vented, or exhausted to surface atmospheric pressure, the pressure has been equalized inside rigid housing 11 to ambient atmospheric pressure. The presence of atmospheric pressure in second chamber 25 can speed up the process of transition of cryogenic fluid 22 from the liquid state to gas 22*a* in the gaseous state to hasten the freezing of slug 45.

After one surface 30 has been cleaned, the diver shakes and/or uses a tool to chip away frozen slug 45 from cryogenic freezing unit 10. The diver may elect to melt and wash away frozen slug 45 by rapidly moving cryogenic freezing unit 10 back and forth in the relatively warmer ambient water 40. The pieces or melting portions of slug 45 may be collected in a water-tight receptacle to remove potential pollution of the environment. After slug 45 has been removed, the diver goes to the next surfaces 30 needing removal of contaminating matter 31 and repeats the procedure until the supply of cryogenic liquid 22 is exhausted.

Where extended cleaning of surfaces 30 is to be done, external storage tanks of cryogenic fluid 22 may be towed and attached to cryogenic freezing unit 10 via appropriately insulated ducts and fittings. Such tasks or larger tasks may require larger versions of cryogenic freezing unit 10 and may need more than one diver to transport it so that suitable carrying handles might be added.

Having the teachings of this invention in mind, different applications, modifications and alternate embodiments of this invention may be adapted. Cryogenic freezing unit 10 can be made in larger or smaller sizes and in a multitude of different shapes, and housing 11 could be made from a wide variety of materials. Cryogenic freezing unit 10 can alternatively be used on land placing the article having surface 30 to be cleaned inside of a shallow pan or sink full of water 40, (other liquids besides water can be used possibly with higher freezing points). These land-based cleaning tasks follow essentially the same procedure described above regarding the cleaning of surface 30 underwater in the ocean. Cryogenic freezing unit 10 is placed on top of the plate-like surface 30 to be cleaned, trapping portion 41 of water 40 inside rim-shaped end portion 13 against surface 30. Cryogenic liquid 22 is allowed to flow from a storage vessel or reservoir chamber 20 into the heat transfer receptacle of chamber 25. Different cryogenic liquids 22 could be selected as will be apparent to one skilled in the art to which this invention pertains. The cold cryogenic liquid 22 boils-off as gas 22*a* on the inside of inner wall portion 12 that helps trap portion 41 of water 40 on its opposite side. Evolved gas 22*a* is vented to air 50 through fitting 27, hose 28, and outlet 29. Heat is transferred and portion 41 and contaminating matter 31 freezes into a frozen slug 45 which also bonds cryogenic freezing unit 10 to surface 30. When sufficiently frozen into slug 45, cryogenic freezing unit 10 is displaced, or pulled away from surface 30, which also pulls away contaminating matter 31, leaving surface 30 clean.

The disclosed components and their arrangements as disclosed herein all contribute to the novel features of this invention. Cryogenic freezing unit 10 of this invention is a portable, cost-effective tool to reliably clean contaminating matter 31 from submerged surfaces 30 without alerting others to reveal the nature of the undersea activity. Therefore, cryogenic freezing unit 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A method of cleaning contaminating matter from a surface underwater comprising the steps of:

providing a cryogenic freezing device including a housing and a chamber enclosed in said housing, said housing having a rim-shaped end portion which is adjacent to said chamber;

placing said rim-shaped end portion of said housing on a surface underwater, wherein said rim-shaped end portion of said housing isolates a portion of water and contaminating matter present on said surface;

venting cryogenic liquid to said chamber;

creating a gas from said vented cryogenic liquid in said chamber;

freezing said portion of water and said contaminating matter isolated in said rim-shaped end portion of said housing by contacting with said gas; and removing said frozen portion of water and said frozen contaminating matter from said underwater surface.

2. The method according to claim 1 further comprising the step of:

interposing a wall portion between said chamber and said rim-shaped end portion of said housing.

3. The method according to claim 2 wherein the removing step comprises displacing said housing to break-away and remove said frozen portion of water and said frozen contaminating matter from said surface.

4. The method according to claim 3 further comprising the step of:

insulating a portion of said housing from ambient water.

5. The method according to claim 4 further comprising the step of:

exhausting said gas from said chamber.

6. The method according to claim 5 further comprising the step of:

including a reservoir of said cryogenic liquid in said housing.

7. The method according to claim 6 further comprising the step of:

venting said cryogenic liquid to said chamber through a valve between said reservoir and said chamber.

8. The method according to claim 7 further comprising the step of:

controlling venting of said cryogenic liquid from said reservoir to said chamber with an actuator extending through an insulating layer on said housing to said valve.

* * * * *